US006161406A

United States Patent [19]

Peters et al.

[11] Patent Number: 6,161,406

[45] Date of Patent: Dec. 19, 2000

[54] METHOD OF PREADJUSTING COLD DEFORMING PLANTS

[75] Inventors: Andreas Peters; Andreas Gramer, both of Düsseldorf; Hans-Peter Richter, Friedewald, all of Germany

[73] Assignee: SMS Schloemann-Siemag Aktiengesellschaft, Düsseldorf, Germany

[21] Appl. No.: 09/349,633

[22] Filed: Jul. 8, 1999

[30] Foreign Application Priority Data

Jul. 14, 1998 [DE] Germany ..... 198 31 480

[51] Int. Cl.[7] ..... B21B 37/00

[52] U.S. Cl. ..... 72/11.1; 72/7.4; 72/365.2

[58] Field of Search ..... 72/7.1, 7.4, 8.3, 72/9.2, 11.1, 11.8, 234, 229, 365.2

[56] References Cited

U.S. PATENT DOCUMENTS 3,665,743 5/1972 Frohling ..... 72/11.8
3,820,366 6/1974 Smith, Jr. ..... 72/8.5
5,054,302 10/1991 Yamashita et al. ..... 72/9.2
5,609,053 3/1997 Ferreira et al. ..... 72/11.8
5,987,948 11/1999 Neushutz et al. ..... 72/7.1

*Primary Examiner*—Ed Tolan
*Attorney, Agent, or Firm*—Friedrich Kueffner

[57] ABSTRACT

A method of preadjusting cold deforming plants, such as cold rolling trains, skin pass stands, stretcher-and-roller levelers, straightening machines, and the like, wherein the hardness of the material to be deformed is measured shortly before the cold deformation of the material and is utilized for correcting its hardening curve and the preadjustment of the cold deforming plant based on the measurement. The standard hardening curve of a material or a group of materials with corresponding standard values of hardness, yield strength, tensile strength, etc., can be corrected by an additive or multiplicative linkage with a correction member which contains at least one tensile strength determined through the measured hardness value.

12 Claims, 1 Drawing Sheet

METHOD OF PREADJUSTING COLD DEFORMING PLANTS

BACKGROUND OF THE INVENTION

1. Field of the Invention

The present invention relates to a method of preadjusting cold deforming plants, such as cold rolling trains, skin pass stands, stretcher-and-roller levelers, straightening machines, and the like.

2. Description of the Related Art

Cold rolling trains are preadjusted prior to the beginning of rolling in reversing configuration and tandem configuration on the basis of a pass schedule precalculation. The purpose of this is to compensate the deformations of the roll stands caused by the precalculated loads and to manufacture a rolled product having the desired dimensions.

The computation of the loads is based on the cold work hardening curve which represents the relationship between the deformation $\epsilon$ and the yield strength $k_f=k_f(\epsilon)$ of the different materials as standard values. Because of the variations of the chemical composition, the differences during cooling after hot-rolling or during the annealing process, and the general structural condition, the real hardening curve deviates to a greater or lesser extent from the standard hardening curve. This is why the pass schedule selection based on the standard values is frequently incorrect; this results in dimensional deviations and requires additional process steps.

SUMMARY OF THE INVENTION

Therefore, it is the primary object of the present invention to provide a method for the optimum pass schedule selection for the respective rolling stock charge.

In accordance with the present invention, the hardness of the material to be deformed is measured shortly before the cold deformation of the material and is utilized for correcting its hardening curve and the preadjustment of the cold deforming plant based on the measurement.

The advantage of the adaptation of the hardening curve through a hardness measurement is the fact that deviations in the yield strength of a material (which depends on the chemical composition, differences during cooling after hot-rolling or during the annealing process, the structural state, and the like) can enter into the pass schedule selection without prior information directly before the beginning of rolling. Another advantage is the fact that different materials with similar hardening behaviors can be handled or administered with only one hardening curve.

In accordance with an advantageous feature, the standard hardening curve of a material or a group of materials with corresponding standard values of hardness, yield strength, tensile strength, etc., is corrected by an additive or multiplicative linkage with a correction member which contains at least one tensile strength determined through the measured hardness value. The adaptation of an existing hardening curve by the additive or multiplicative linkage with a correction member can be realized in a simple manner.

In accordance with an advantageous further development of the invention, the difference between the rolling force of the first stand or of the first pass precalculated by means of the hardness measurement and the rolling force effectively measured during rolling, is utilized for correcting by computation the precalculated rolling force of the respectively following roll stand in tandem plants or the following pass in reversing plants. Since a further adaptation of the hardening curve by measuring the hardness between the roll stands of a tandem train is not possible, from the difference between precalculated and measured rolling force of a roll stand is determined a correction value determined only by computation for the rolling force of the respectively following roll stand.

In reversing stands, a hardness measurement for each pass is possible, but is expensive and time-consuming. However, it is sufficient to measure the hardness only when entering the first pass and to take into consideration deviations from the rolling force deducted therefrom as a correction value for the second pass. If the measured rolling force should still deviate too much from the precalculated rolling force, another hardness measurement before the third pass is useful.

It is also advantageous to carry out the adaptation of the standard hardening curve in accordance with the respectively measured hardness of the rolling stock and after evaluated deviations and correction values of the rolling force of rolling procedures which have been carried out earlier. The statistical evaluation of a number of rolling procedures offers the assurance of an accurate correction of the process steps taking place following the first roll stand or the first pass.

If the hardness measurement is carried out dynamically and preferably at several locations of the material to be deformed, the required measuring time is minimized and the average of the measurement results is formed which, thus, is representative for the respective charge. Preferably, the EQUOTIP measurement method which is known in the art is used.

Since, in addition to the hardness, also the temperature and the surface friction of the material to be deformed are measured, additional important parameters are taken into consideration which influence the hardening curve.

In accordance with another advantageous feature, the hardness measurement takes place preferably during periods in which the operation of the cold deforming plants requires a standstill. This means that there are no delays in the production sequence. For example, the hardness measurement can be carried out in tandem trains preferably between the uncoiler and the welding machine during welding and, thus, the welding time can be utilized. Similarly, the hardness measurement takes place in reversing trains preferably in the area in front of the thickness measuring devices during the calibration thereof and, thus, also does not require any additional time.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
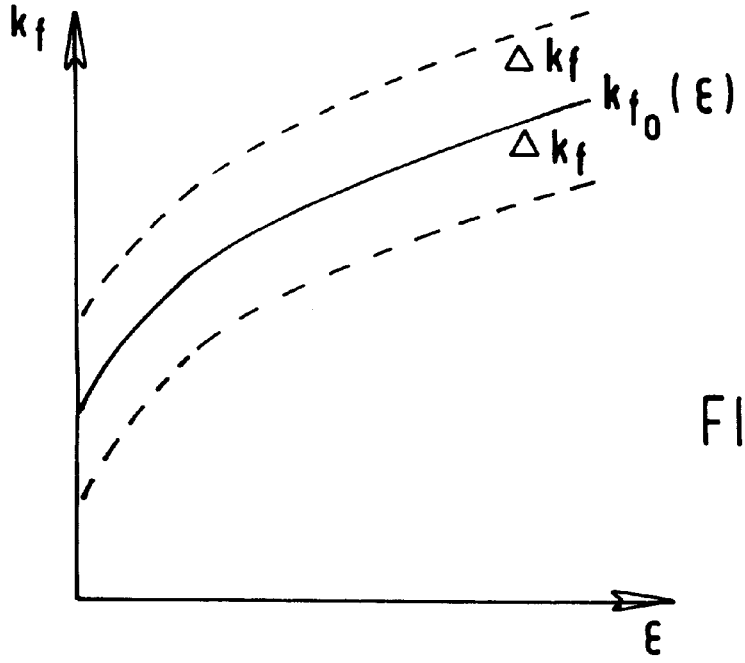
FIG. 1 is a diagram showing a hardening curve with additive correction.
Figure 2:
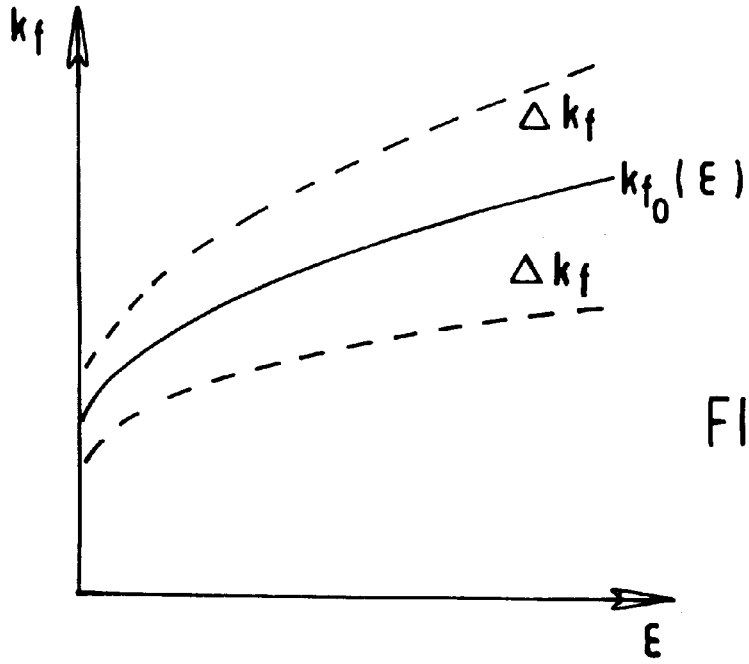
FIG. 2 is a diagram showing a hardness curve with multiplicative correction.

In FIGS. 1 and 2, the standard hardening curves with hardening force $k_{f0}$ as a function of the deforming distance ($\epsilon$) are shown in solid lines and the corrected hardening curves $k_{f1}(\epsilon)$ are shown in broken lines.

In FIG. 1, $k_{f0}(\epsilon)$ and $k_{f1}(\epsilon)$ differ from each other by an additive correction member $$\pm\blacktriangle k_f = k(H_0, H_1, R_{m0} \ldots) \cdot k_{f0}(0)$$

wherein $k_{f0}(0)$=beginning value of the standard hardening curve at $\epsilon=0$;

$H_0$=standard hardness value;

$H_1$=measured hardness value;

$R_{m0}$=standard tensile strength.

Consequently:

$$k_{f1}(\epsilon) = k_{of}(\epsilon) + \blacktriangle k_f$$

In FIG. 2, each $k_f(\epsilon)$ is multiplied with the factor $k(H_0, H_1, R_{m0} \ldots)$.

Consequently:

$$\text{i } k_{f1}(\epsilon) = k_{f0}(\epsilon) \cdot k(H_0, H_1, R_{m0} \ldots)$$

Both correction models represent the influence of the measured hardness $H_1$ on the hardening force $k_{f1}(\epsilon)$.

The method according to the present invention is not only suitable for cold rolling trains, but also for all types of skin pass stands, stretcher-and-roller levelers, straightening machines and levelling machines (strip and sheet metal), as well as for cold section straightening machines and cold rolling trains for sections and wire.

While specific embodiments of the invention have been shown and described in detail to illustrate the inventive principles, it will be understood that the invention may be embodied otherwise without departing from such principles.

What is claimed is:

1. A method of preadjusting cold deforming plants, the method comprising measuring a hardness of the material to be deformed shortly before a cold deformation of the material, and utilizing the measurement for correcting a hardness curve of the material and for a preadjustment of the cold deforming plant based on the measurement.

2. The method according to claim 1, comprising correcting a standard hardening curve of a material or a group of materials with corresponding standard values of at least one of hardness, yield strength, and tensile strength, by an additive or multiplicative linkage with a correction member, wherein the correction member contains at least one tensile strength determined through the measured hardness value.

3. The method according to claim 1, comprising using a difference between the rolling force of a first stand precalculated by the hardness measurement and the rolling force effectively measured during rolling for correcting by computation the precalculated rolling force of the respectively following roll stand of a tandem plant.

4. The method according to claim 1, comprising using a difference between the rolling force of a first pass precalculated by the hardness measurement and the rolling force effectively measured during rolling for correcting by computation the precalculated rolling force of the respectively following pass in a reversing plant.

5. The method according to claim 2, comprising carrying out an adaptation of the standard hardening curve in dependence on the measured hardness of the rolling stock and in dependence on evaluated deviations and correction values of the rolling force of rolling processes carried out earlier.

6. The method according to claim 1, comprising dynamically carrying out the hardness measurement.

7. The method according to claim 6, comprising carrying out the hardness measurement in accordance with the EQUOTIP measuring method.

8. The method according to claim 1, comprising carrying out the hardness measurement at several locations of the material to be deformed.

9. The method according to claim 1, comprising measuring in addition to the hardness a temperature and surface friction of the material to be deformed.

10. The method according to claim 1, comprising carrying out the hardness measurement during periods of standstill of the cold deforming plant.

11. The method according to claim 1, comprising carrying out the hardness measurement in tandem trains between an uncoiler and a welding machine during welding.

12. The method according to claim 1, comprising carrying out the hardness measurement in reversing trains in an area in front of thickness measuring devices during a calibration thereof.

* * * * *